US005176302A

United States Patent [19]

Smith

[11] Patent Number: 5,176,302

[45] Date of Patent: Jan. 5, 1993

[54] BELT MOUNTED CAN HOLDER

[76] Inventor: Edwin Smith, 152 Georges Rd., Dayton, N.J. 08810

[21] Appl. No.: 686,788

[22] Filed: Apr. 17, 1991

[51] Int. Cl.[5] ..... A45F 5/02

[52] U.S. Cl. ..... 224/252; 224/148; 224/225; 224/904; 24/3 D; 24/3 J; 24/3 R

[58] Field of Search ..... 224/148, 224–226, 224/248, 252, 253, 267–269, 271, 904; 24/3 D, 3 F, 3 H, 3 J, 3 K, 3 L, 3 R, 343

[56] References Cited

U.S. PATENT DOCUMENTS

| | | | |
|---|---|---|---|
| 220,550 | 10/1879 | Schaub | 224/248 X |
| 344,152 | 6/1886 | Barker | 224/225 |
| 1,053,183 | 2/1913 | Keller | 24/3 K |
| 1,270,158 | 6/1918 | Hill | 224/252 |
| 1,281,656 | 10/1918 | Raschick | 24/3 K |
| 1,341,930 | 6/1920 | Roblin | 24/3 K |
| 1,613,390 | 1/1927 | Gillette | 24/3 K |
| 1,618,573 | 2/1927 | Cole | 24/3 H |
| 2,001,291 | 5/1935 | Tonko | 24/3 K |
| 2,551,019 | 5/1951 | LaPierre | 24/3 D |
| 3,493,152 | 2/1970 | Ort | 224/268 X |
| 5,016,791 | 5/1991 | Burow | 224/148 |

*Primary Examiner*—Henry J. Recla
*Assistant Examiner*—Casey Jacyna
*Attorney, Agent, or Firm*—Louis Weinstein

[57] ABSTRACT

A holder for the handle of a container comprises a substantially rigid, continuous wire-like member bent to form a belt receiving portion and an integral handle receiving portion. The belt receiving portion stabilizes the position of the holder and the handle receiving portion is provided with first and second locking portions through which the container handle must pass before resting at the bottom of the handle receiving portion. The container is thus maintained in a stable, convenient position when the wearer is moving his body and/or walking, freeing the user's hands for other operations while at the same time permitting convenient access to the contents of the can and further providing a sturdy and yet small and lightweight holder.

7 Claims, 2 Drawing Sheets

BELT MOUNTED CAN HOLDER

FIELD OF THE INVENTION

The present invention relates to holders and, more particularly, to a novel belt or strap mounted holder for supporting and carrying a can, such as a paint can, in a stable manner, and freeing the hands of the carrier.

BACKGROUND OF THE INVENTION

It is desirous to provide a convenient means for transporting and/or gaining access to the contents of cans, such as paint cans, to facilitate handling transportation and use.

For example, for activities such as painting, a paint can is typically carried by grasping an integral, thin, wire-like handle to the painting site which may, for example, require climbing a ladder to reach the area to be painted. It is difficult and often dangerous to attempt to hold and carry a paint can at the same time that the painter is ascending (or descending) a ladder. In addition, it is also difficult and possibly dangerous for one to apply paint to a surface simultaneously with the holding of the paint can. Although the paint can may obviously be set down at the time that the paint is being applied, this operation may necessitate undue and possibly dangerous bending or other body movement between the activities of painting and replenishing the paint brush with paint. This is especially true when working on a ladder or other elevated surface. It thus becomes extremely advantageous to provide a holder which eliminates the above-mentioned disadvantageous operations while providing a lightweight holder which supports a paint can in a stable manner and at a location which substantially eliminates the bending or other body movements necessary to gain access to the contents of the paint can.

BRIEF DESCRIPTION OF THE INVENTION

The present invention solves the above-described problems while providing a paint can holder which is characterized by being comprised of a single continuous one-piece wire-like member which is substantially rigid and is bent to form a belt or strap receiving portion and an integral handle receiving portion provided with first and second locking portions through which the handle must pass before coming to rest at the base of the handle supporting portion. The belt or strap receiving portion is comprised of a pair of loops through which the belt passes and which are arranged in substantially spaced parallel fashion to facilitate the holder being maintained in a stable fashion upon the belt or strap.

The handle receiving portion is comprised of a bent section which cooperates with the belt or strap receiving portion to form first and second locking portions through which the handle must pass before being seated at the bottom or handle supporting portion. The handle supporting portion is comprised of two spaced, substantially U-shaped sections which support i the can in a stable manner and further locate the can conveniently just below the waist of the wearer to facilitate access to the contents thereof.

Although the holder will be maintained in a predetermined position once located thereat, the holder is nevertheless free to be slidably positioned along the belt or strap extending through its belt receiving loop portions to accommodate the needs and/or desires of the wearer.

The can holder is compact and light in weight while being sufficiently sturdy to withstand lengthy periods of hard use. The holder is preferably formed of a suitable metallic member of sufficient gauge or thickness as to be sufficiently rigid and yet capable of being bent into a desired shape and of retaining its bent configuration in use. The wire-like material is preferably carbon steel.

The holder will conveniently hold a one gallon paint can in place by a painter's side. The unique, dual, snap-in feature provided by the locking means prevents the paint can from falling off the holder while the painter is ascending or descending a ladder, providing the painter with the freedom to carry a paint can, such as a one gallon paint can, while enabling the painter to use both of his hands while moving about in the performance of a painting operation as well as when ascending or descending a ladder.

OBJECTS OF THE INVENTION

It is, therefore, one object of the present invention to provide a novel paint can holder which is lightweight, strong and capable of holding a paint can in a stable fashion.

Still another object of the present invention is to provide a novel paint can holder adapted to be mounted upon the belt or strap of a user.

Still another object of the present invention is to provide a novel paint can holder having a dual snap-in feature for preventing the handle of a paint can from being dislodged from the holder carrying same.

Still another object of the present invention is to provide novel lightweight and yet rugged belt mounted paint can holder which is preferably formed of a continuous piece of a substantially rigid elongated wire-like member.

Still another object of the present invention is to provide a rugged paint can holder of the type described above and capable of achieving the above-mentioned objectives member bent into the proper configuration.

The above, as well as other objects of the present invention will become apparent when reading the accompanying description and drawing, in which:

DETAILED DESCRIPTION OF THE INVENTION

Figure 1A:
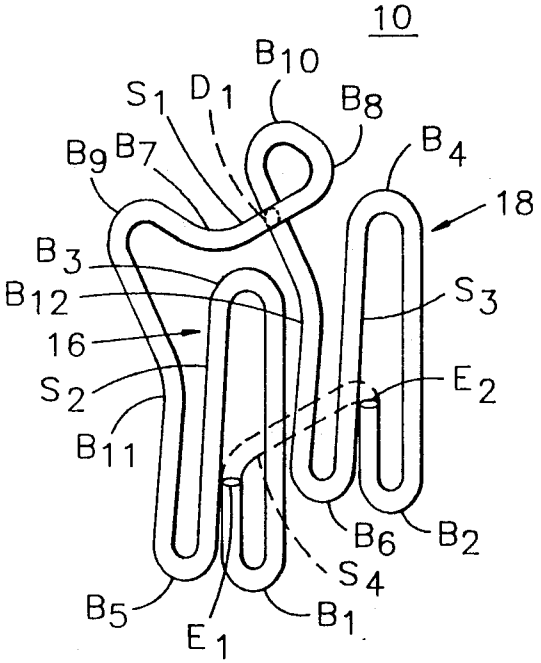
FIG. 1*a* shows a perspective view of a can holder embodying the principles of the present invention.
Figure 1C:
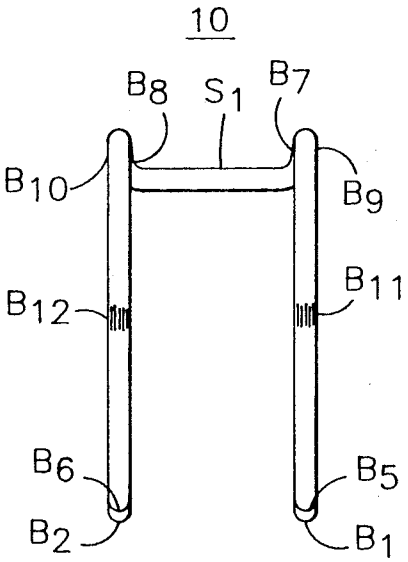
FIG. 1*c* shows a rear elevational view of the holder of FIG. 1*a;*
Figure 1B:
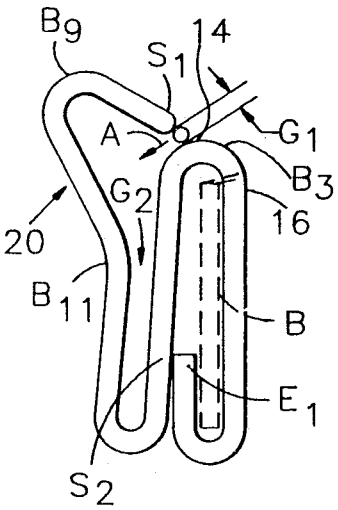
FIG. 1*b* shows a side elevational view of the holder of FIG. 1*a;*
Figure 1D:
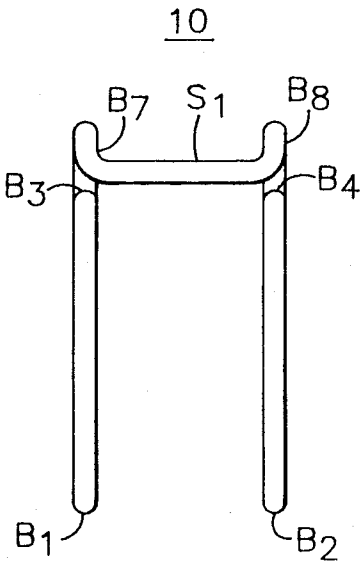
FIG. 1*d* shows a front elevational view of the holder of FIG. 1*a*.
Figure 2:
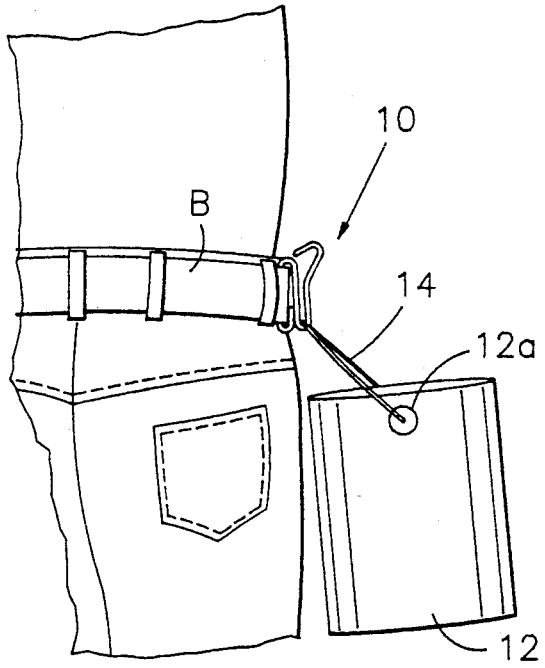
FIG. 2 shows a perspective view of the holder of FIGS. 1*a*–1*d* being mounted on a user's belt and supporting a paint can.

FIGS. 1*a*–1*d* and 2 show a novel holder 10 embodying the principles of the present invention for utilization in supporting a paint can 12 having a substantially semicircular shaped, wire-like handle 14 swingably mounted to paint can 12 at two pivot locations near the top thereof. FIG. 2 shows one of the pivot connections 12*a*. The holder 10 is shown mounted on the belt B of a wearer W.

The holder 10 is shown in greater detail in FIGS. 1*a*–1*d* and is preferably formed of a single substantially rigid elongated continuous wire-like member which is bent in the manner shown in FIGS. 1*a*–1*d* to form the holder 10. The wire-like member is preferably formed of carbon steel but may be formed of any suitable material capable of providing the strength, durability and lightweight characteristics of the holder 10 of the present invention.

The holder 10 is comprised of first and second spaced, substantially parallel belt receiving portions 16 and 18 each of which defines a substantially elongated oval or racetrack-shaped loop for receiving a belt B shown in dotted fashion in FIG. 1*b*. Each loop 16, 18 comprises one free end El and E2 of the elongated one-piece wire-like member forming the holder wherein a substantially U-shaped bend Bl, B2 is provided in each loop a spaced distance away from associated ends E1 and E2 respectively. A second U-shaped bend B3, B4 for each loop is arranged a spaced distance from bends B1, B2 respectively, thereby forming the loops 16 and 18.

A spaced distance from the bends B3 and B4, and adjacent bends B1 and B2, there are provided respective substantially U-shaped bends B5 and B6 which form the supporting bends adapted to support the paint can handle 14, as shown in FIG. 2, which bends are at the bottom or lower end of the handle receiving portion 20 of holder 10. The handle receiving portion is provided w a straight spanning portion S1 which cooperates with the bend portions B3 and B4 in a manner to be more fully described to form a first locking portion. The wire-like member is bent to form substantially L-shaped bends B7 and B8, the wire-like portion extending rearwardly from portion Sl then bending downwardly to form substantially C-shaped bends B9 and B10 such that the wire portions of said bends extend in a downward diagonal direction. Gradual bends B11 and B12 provided in the wire beneath the bends B9 and B10 cooperate with adjacent straight portions S2, S3 of the loops 16 and 18 to provide a second locking feature forming part of the handle portion of holder 10. The wire portions extend downwardly from the bends B11 and B12 and merge into the bottom or lower U-shaped bends B5 and B6 described hereinabove.

The loops 16 and 18 are preferably arranged in spaced parallel fashion and serve to maintain the holder 10 in a stable position upon the belt B of the wearer W. The holder may be slidably moved to any position along the belt, one preferred position being shown in FIG. 2 wherein the holder is arranged adjacent one hip of the wearer.

As an alternative, the straight section S1 bridging the loops may be split at its center as shown by dotted line D1 and bridging section S4 may be arranged between loops. Thus, the one-piece design feature is easily retained.

The manner of use of the holder is as follows:

The belt B of the wearer (or other suitable strap) is threaded through loop portions 16 and 18 in the manner shown in FIG. 2 with the handle holding portions defined by bends B5 and B6 oriented so as to be in the downward position and with the handle holding portion extending away from the belt and body of the wearer W (see also FIG. 2).

The handle 14 is positioned adjacent to the region of the cross-section S1 and the bends B3, B4 as shown in dotted fashion in FIG. 1*b*. The handle is then moved in the direction shown by arrow A and is pushed through the gap space region between S1 and the adjacent surfaces of bends B3 and B4. The gap space is preferably chosen so that it is slightly less than the thickness of the handle 14 in order to prevent the handle 14 from becoming inadvertently dislodged from the handle holding portion.

The gap space G2 between bends B11 and B12 and the adjacent surfaces of the portions S2 and S3 of loops 16 and 18 is also preferably slightly less than the thickness of the handle 14 requiring that the handle 14 be pressed downwardly so that it may rest upon the adjacent surfaces of bends B5 and B6 in the manner shown best in FIG. 2. The second locking region likewise prevents the handle 14 from inadvertently becoming dislodged from the handle holding portion. The provision of a pair of support portions defined by bends B5 and B6 which are arranged a spaced distance apart further acts to stabilize the paint can and preventing the can from swaying and thereby holding it in a stable position while in use during the painting operation as well as providing stability and freeing both hands of the painter while ascending or descending a ladder, or a flight of steps for that matter.

In addition to maintaining the paint can in a stable position, the holder further maintains the paint can in a convenient location to facilitate the operator dipping a paint brush into the contents of the paint can without the necessity for any undue bending or movement to gain access to the contents thereof. This is especially important when working in elevated and/or confined spaces.

Although the paint can is maintained in a stable position during use, only a very slight force is required to lift the handle from the handle supporting portion of holder 10 to remove the paint can from the holder. The small, compact size of the holder permits the holder to be retained upon the wearer's belt even when not supporting a paint can since the holder does not hinder the operator from performing any desired function with the holder mounted on the wearer's belt.

Although the invention has been described for use in supporting a paint can, any type of handle may be supported with the holder , the present invention. The relatively lightweight and compact size of the compact holder which is derived from the fact that the holder is formed of a continuous one-piece wire-like member having suitable rigidity and yet being bendable to form the configuration of the holder, greatly facilitates its use. Although the holder of the present invention is preferably formed of carbon steel, any other material having the desired characteristics described hereinabove may be utilized.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A holder for cans and the like having a handle portion and a container portion, said handle portion being a wire-like member coupled to a top, open end of the container portion, said holder being comprised of a belt supporting portion and an integral handle supporting portion;

said belt supporting portion being comprised of first and second elongated narrow loops adapted to slidably receive a belt therebetween, said loops being arranged in substantially spaced parallel fashion to enhance the stability of the belt mounting portion upon said belt and hence the stability of said holder;

said handle supporting portion being integral with said loops and comprising a pair of handle supports arranged adjacent to a lower end of said first and second loops and each having a locking portion integral with and extending upwardly from said handle holding portions and cooperating with adjacent portions of said loops to form narrow gap spaces which are less than the thickness of the handle portion to provide a pair of first locking means which necessitates that the handle portion to be supported therein be forced through said gap spaces to be held by said handle supporting portions whereby said container portion is positioned below said holder and is suspended from said handle portion wherein said holder is formed from a single unitary continuous elongated rod-like member.

2. The holder of claim 1 wherein said handle supporting portion further comprises a second locking means integral with and displaced from said first locking means includng a pair of second locking portions each of which forms a second gap space with adjacent portions of an associated one of said loops at locations at the upper ends thereof to provide a locking arrangement wherein the handle portions to be supported by said handle supporting portion must be forced through both said second gap spaces and said first gap spaces, said first and second locking means defining a double locking feature to prevent inadvertent dislodging or removal of the handle portion from said handle supporting portion.

3. The holder of claim 1 1 wherein said rod-like member is formed of a material which is substantially rigid and yet capable of being bent to form the loop portions and integral handle supporting portions of said holder.

4. The holder of claim 3, wherein said material is metal.

5. The holder of claim 4 wherein said metal is carbon steel.

6. The holder of claim 1 wherein said wire-like member is bent to form first and second substantially U-shaped portions for each of said first and second loops and is bent to form third and fourth substantially U-shaped handle holding portions adjacent said first and second U-shaped portions each forming a part of said first and second loops and being bent a spaced distance from each of said third and fourth U-shaped portions to define said first locking portion and being bent to form fifth and sixth substantially U-shaped portions and thereafter bent to form first and second substantially L-shaped portions whereby a spanning portion between each of said L-shaped portions cooperates with adjacent portions of said first and second loops to define said second locking portion.

7. The holder of claim 1 wherein said wire-like member is bent to form first and second substantially U-shaped portions for each of said first and second loops and is bent to form third and fourth substantially U-shaped handle holding portions adjacent said first and second U-shaped portions each forming a part of said first and second loops and being bent a spaced distance from each of said third and fourth U-shaped portions tod efine said first locking portion and being bent to form fifth and sixth substantially U-shaped portions and tehreafter bent to form first and second substantially L-shaped portions whereby the legs of said L-shaped portions extending towards one another each cooperate with adjacent portions of said first and second loops to define said second locking portion.

* * * * *